US007608164B2

(12) United States Patent
Chou et al.

(10) Patent No.: US 7,608,164 B2
(45) Date of Patent: Oct. 27, 2009

(54) FABRIC-CREPE PROCESS WITH PROLONGED PRODUCTION CYCLE AND IMPROVED DRYING

(75) Inventors: Hung Liang Chou, Neenah, WI (US); Mark S. Hunter, Green Bay, WI (US); Kang Chang Yeh, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 12/033,207

(22) Filed: Feb. 19, 2008

(65) Prior Publication Data

US 2008/0264589 A1 Oct. 30, 2008

Related U.S. Application Data

(60) Provisional application No. 60/903,789, filed on Feb. 27, 2007.

(51) Int. Cl.
*B31F 1/12* (2006.01)
*D21F 7/00* (2006.01)

(52) U.S. Cl. ..... 162/112; 162/198; 162/199; 34/425

(58) Field of Classification Search ..... 162/109, 162/111–113, 115–117, 123–133, 193, 198, 162/199; 156/183; 264/282–283; 226/7, 226/91, 97.3; 34/114, 117, 122, 359, 444, 34/425; 700/127–128
See application file for complete search history.

(56) References Cited

U.S. PATENT DOCUMENTS 1,971,951 A 8/1934 Skirrow et al. ..... 260/2
2,109,883 A 3/1938 Herrmann et al. ..... 260/2
2,954,868 A * 10/1960 Swedish, Jr et. al. ..... 428/153
3,476,644 A * 11/1969 Krehnbrink ..... 162/111
3,556,932 A 1/1971 Coscia et al. ..... 162/166
3,556,933 A 1/1971 Williams et al. ..... 162/167
3,700,623 A 10/1972 Keim ..... 260/80.3 R
3,772,076 A 11/1973 Keim ..... 117/155 R
3,974,025 A 8/1976 Ayers ..... 162/113
4,239,065 A 12/1980 Trokhan ..... 139/383 A (Continued)

FOREIGN PATENT DOCUMENTS

WO WO 2007/001837 A2 1/2007

OTHER PUBLICATIONS

Chapter 2: Alkaline-Curing Polymeric Amine-Epichlorhydrin by Espy in Wet Strength Resins and Their Application (L. Chan, Editor, 1994); Trivedi et al., J. Am. Oil Chemist's Soc., Jun. 1981, pp. 754-756; Westfelt in Cellulose Chemistry and Technology, vol. 13, p. 813, 1979.

(Continued)

*Primary Examiner*—José A Fortuna
(74) *Attorney, Agent, or Firm*—Michael W. Ferrell

(57) ABSTRACT

A method of manufacturing absorbent sheet is directed to a wet-press/fabric-crepe process wherein add-on of adhesive to the Yankee surface is at relatively low levels, yet sheet transfer is maintained and production increased. Materials are selected and process parameters are controlled such that a paper machine can be operated for at least 4 hours before the Yankee coating needs to be stripped. Preferably, average increase in Yankee hood temperature is less than 1° F./minute during a production interval.

55 Claims, 7 Drawing Sheets

U.S. PATENT DOCUMENTS

| | | | | |
|---|---|---|---|---|
| 4,440,597 | A | 4/1984 | Wells et al. | 162/111 |
| 4,448,638 | A | 5/1984 | Klowak | 162/112 |
| 4,482,429 | A | 11/1984 | Klowak | 162/111 |
| 4,490,925 | A | 1/1985 | Smith | 34/42 |
| 4,528,316 | A | 7/1985 | Sorens | 524/503 |
| 4,529,480 | A | 7/1985 | Trokhan | 162/109 |
| 4,551,199 | A | 11/1985 | Weldon | 162/109 |
| 4,689,119 | A | 8/1987 | Weldon | 162/281 |
| 4,720,383 | A | 1/1988 | Drach et al. | 424/70 |
| 4,834,838 | A | 5/1989 | Klowak | 162/109 |
| 4,849,054 | A | 7/1989 | Klowak | 162/109 |
| 5,449,026 | A | 9/1995 | Lee | 139/383 A |
| 5,607,551 | A | 3/1997 | Farrington, Jr. et al. | 162/109 |
| 5,660,687 | A | 8/1997 | Allen et al. | 162/111 |
| 5,690,149 | A | 11/1997 | Lee | 139/383 A |
| 5,833,806 | A | 11/1998 | Allen et al. | 162/111 |
| 6,287,426 | B1 | 9/2001 | Edwards et al. | 162/281 |
| 6,336,995 | B1 * | 1/2002 | Campbell | 162/111 |
| 6,350,349 | B1 | 2/2002 | Hermans et al. | 162/111 |
| 7,048,826 | B2 * | 5/2006 | Archer et al. | 162/111 |
| 7,404,875 | B2 * | 7/2008 | Clungeon et al. | 162/111 |
| 2004/0060675 | A1 * | 4/2004 | Archer et al. | 162/111 |
| 2004/0177940 | A1 * | 9/2004 | Archer et al. | 162/199 |
| 2004/0211534 | A1 * | 10/2004 | Clungeon et al. | 162/111 |
| 2005/0006040 | A1 * | 1/2005 | Boettcher et al. | 162/111 |
| 2005/0217814 | A1 * | 10/2005 | Super et al. | 162/111 |
| 2005/0245669 | A1 * | 11/2005 | Clungeon et al. | 524/515 |
| 2007/0204966 | A1 * | 9/2007 | Chou et al. | 162/199 |
| 2008/0105394 | A1 * | 5/2008 | Kokko | 162/111 |
| 2008/0245492 | A1 * | 10/2008 | Edwards et al. | 162/111 |

OTHER PUBLICATIONS

Egan, J.Am. Oil Chemist's Soc., vol. 55 (1978), pp. 118-121; Evans, Chemistry and Industry, Jul. 5, 1969, pp. 893-903; and Finch et al., Ed. Polyvinyl Alcohol Developments (Wiley 1992), pp. 84-93.

* cited by examiner

FABRIC-CREPE PROCESS WITH PROLONGED PRODUCTION CYCLE AND IMPROVED DRYING

CLAIM FOR PRIORITY

This non-provisional application is based upon U.S. Provisional Patent Application Ser. No. 60/903,789, of the same title, filed Feb. 27, 2007. The priority of U.S. Provisional Patent Application Ser. No. 60/903,789 is hereby claimed and the disclosure thereof is incorporated into this application by reference.

TECHNICAL FIELD

The present invention relates to an improved fabric-crepe process for making absorbent sheet such as paper tissue or towel. Adhesive add-on to a Yankee drying cylinder is at relatively low levels, providing prolonged production cycles between stripping of excess coating from a Yankee drying cylinder. A heated backing cylinder dries the web prior to transfer to the Yankee dryer, reducing the load on the Yankee hood.

BACKGROUND ART

Fabric-creping has been employed in connection with papermaking processes which include mechanical or compactive dewatering of the paper web as a means to influence product properties. See U.S. Pat. Nos. 4,689,119 and 4,551,199 of Weldon; 4,849,054 and 4,834,838 of Klowak; and 6,287,426 of Edwards et al. While in many respects, these processes have more potential than conventional papermaking processes in terms of energy consumption and the ability to use recycle fiber, operation of fabric-creping processes has been has hampered by the difficulty of effectively transferring a web of high or intermediate consistency to a dryer. Note also U.S. Pat. No. 6,350,349 to Hermans et al. which discloses wet transfer of a web from a rotating transfer surface to a fabric. Further United States Patents relating to fabric-creping more generally include the following: U.S. Pat. Nos. 4,834,838; 4,482,429; 4,448,638 as well as 4,440,597 to Wells et al.

More recently, high-speed fabric-crepe processes have been developed as is seen in U.S. application Ser. No. 10/679,862, filed Oct. 6, 2003, entitled "Fabric-crepe Process for Making Absorbent Sheet"; GP-02-12). The level of adhesion of the papermaking web to a Yankee dryer cylinder is of importance as it relates to transfer of the web from a creping fabric to the drying cylinder, as well as control of the web in-between the dryer and the reel upon which a roll of the paper is being wound. Webs which are insufficiently adhered may blister or, even worse, become disengaged from a drying cylinder and cause a hood fire.

Moreover, wet-tack is critical in fabric-crepe processes where insufficient wet-tack may lead to a transfer failure wherein the web fails to transfer from a creping fabric to a drying cylinder and remains imbedded in a fabric causing shutdowns and waste of material and energy.

Further, the level of adhesion of the papermaking web to the dryer is of importance as it relates to the drying of the web. Higher levels of adhesion reduce the impedance to heat transfer and cause the web to dry faster, enabling more energy efficient, higher speed operation; provided excessive build-up of adhesive is avoided. Note, however, that some build-up is desirable inasmuch as adhesion of the sheet to the dryer occurs largely by means of creping adhesive deposited in previous passes. Thickness of a coating layer on a Yankee drying cylinder tends to increase with time, insulating a wet web from the Yankee surface to the web. In other words, the adhesive coating build-up on the Yankee reduces heat transfer from the Yankee surface. To maintain the same moisture level in the finished product, the Yankee hood temperature (and energy input to the web) is increased accordingly. After a production interval of two hours or so, the hood temperature reaches its upper ceiling and the coating layer needs to be stripped off to reduce the hood temperature to a normal operating window. A new cleaning doctor is typically used to strip off the old coating build-up.

Stripping of the coating, however, results in sheet transfer problems at the pressure roll due to blistering and edge floating. Further details are seen in copending U.S. Provisional Patent Application Ser. No. 60/779,614, entitled "Method of Controlling Adhesive Build-Up on a Yankee Dryer", filed Mar. 6, 2006; GP-06-1), the disclosure of which is incorporated herein by reference.

Even if the stripping operation is accomplished efficiently, downtime reduces production significantly.

Initially, operation of high-speed fabric-crepe processes was based, in part, on the belief that the wet-tack required for effective transfer from a creping fabric to a Yankee drying cylinder was best achieved with relatively wet sheet and relatively high levels of creping adhesive, especially a hygroscopic re-wettable adhesive such as polyvinyl alcohol resin.

It has been unexpectedly found in accordance with the present invention that low levels of creping adhesive on a Yankee drying cylinder are advantageously employed in a production process with a heated cylinder upstream of the Yankee.

SUMMARY OF THE INVENTION

In accordance with the present invention, adhesive add-on to a Yankee drying cylinder is at relatively low levels and Yankee hood temperature increase is kept below about 1° F./minute during a production campaign for making fabric-creped sheet. Substantial increases in productivity, 20% and more in a commercial paper machine, are realized by keeping adhesive add-on low while maintaining sheet-transfer to a Yankee dryer.

The process of the present invention provides a pre-dried sheet to a transfer nip between a creping fabric and a Yankee drying cylinder by way of wet-pressing and heating the web prior to transfer to the Yankee for further drying. The inventive process includes compactively dewatering a papermaking furnish to form a cellulosic web and concurrently applying the web to a heated rotated backing cylinder. The web is then fabric-creped from the backing cylinder at a consistency of from about 30 to about 60% with a patterned creping fabric such that the web is creped from the backing cylinder surface and transferred into the creping fabric. A resinous adhesive coating composition is supplied to the surface of a heated drying cylinder of a Yankee dryer; advantageously at add-on rates of less than 20 mg/m$^2$ of drying cylinder surface such that a resinous adhesive coating is formed. The Yankee dryer may have a dryer hood with a characteristic operating temperature limit of about 850° F. or so. The web is transferred from the creping fabric to the surface of the heated drying cylinder of the Yankee dryer and adhered to the drying cylinder by the resinous adhesive coating, whereupon the web is dried on the surface of the drying cylinder. The dried web is removed from the drying cylinder surface, by peeling or creping, for example. Inasmuch as adhesive tends to build up on the Yankee drying cylinder; it is periodically stripped as the characteristic operating temperature limit of the drying hood of the Yankee dryer is approached. The furnish and adhesive composition are selected and process parameters are controlled such that a production interval between successive stripping of adhesive coatings from the Yankee cylinder has duration of at least four hours, and preferably for 5 hours or more.

The advantages of the present invention thus include both increased drying capacity and prolonged production cycles, the combination of which significantly increases the amount of production available from a paper machine.

More sheet dryness is achieved prior to transfer to the Yankee, for example, by heating the backing roll and increasing the pressure in the transfer nip to the backing roll. When the sheet has a higher % solids it carries less water to the Yankee dryer. Without intending to be bound by any theory, it is believed adhesion to the Yankee improves because the coating remains more concentrated, i.e., less diluted by water than under conventional conditions. This provides the opportunity to reduce the adhesive add-on during processing and provides for extending production cycles. Shoe-press loading during compactive dewatering can also be used to increase sheet dryness prior to the Yankee dryer. For example, shoe press loading at transfer to the backing cylinder may be set at 725 PLI and backing roll steam pressure may be set at about 95-100 psig. This produces relatively high dryness in the sheet prior to transfer to the Yankee in a pressure nip. Yankee cylinder coating add-on may be reduced to about 15 mg/m$^2$ of drying cylinder surface or less and a coating stripping cycle is readily extended to 5 hours or more by making the foregoing modifications to the process. A production interval between successive stripping of coating of 8-10 hours is desirable.

In another aspect of the invention, it is was found that pre-dried papermaking fibers provide for increased processing rates and still further extending the production interval between required stripping operations. Without intending to be bound by theory, possible explanations include less ionic trash and lower fines which may interfere with adhesion to the Yankee cylinder. It is also believed that pre-drying the pulp produces drying hysteresis in the pulp allowing for more efficient drying of the furnish, further reducing processing times. That is, "slush" pulps, those less than about 80% air-dry, are believed to contain relatively large amounts of tightly-bound water in the fiber that requires more heat to remove than is the case with commercial pre-dried pulp.

Proper selection of a coating package also facilitates practice of the inventive process. A preferred coating package includes PVOH resin, polyamidoamine adhesive resin, and a creping modifier. Preferred coating compositions provide for good sheet transfer with fast coating recovery after a blade change, and allows for reducing the coating to 15 mg/m$^2$ of dryer surface or less during production at continuous operation of the paper machine. Preferably, the coating package is stable to a temperature of at least about 300° F. such that this temperature can be maintained during a production campaign.

A synergistic effect was realized as the above aspects of the invention were employed during testing. A machine was sped up by 14.2% for towel manufacture and the total production was increased 20% due to the shorter coating recovery time and longer coating/stripping cycle. Such advantages of the present invention are appreciated by reference to FIGS. 1-5, which present operating data on the same paper machine operated under different conditions as noted on the Figures. FIG. 1 is a plot of Yankee hood temperature versus time for a commercial paper machine operated with a hood temperature limit of 850° F. It is seen that operation of the machine is maintained below the hood temperature limit for 5-6 hours when employing an adhesive add-on rate of 10 mg/m$^2$. When the operating temperature limit is reached, the Yankee coating is stripped and operation resumed. When operating the same paper machine under similar conditions with twice the adhesive add-on rate, it is seen in FIG. 2 that the Yankee coating must be stripped every 3 hours or so.

Energy usage in the Yankee hood is likewise reduced in accordance with the invention as seen in FIGS. 3-5. FIG. 3 is a plot of Yankee hood gas usage versus time for the same paper machine and production runs discussed above in connection with FIG. 1. It is seen in FIG. 3 that Yankee hood energy consumption starts at about 2 MMBtu/ton after stripping a coating from the Yankee and increases to about 4 MMBtu/ton over a 5-6 hour period. Note also, that hood energy usage is kept below 3 MMBtu/ton of sheet produced for 1-2 hours.

FIG. 4 is a plot of Yankee hood energy consumption versus time for the same paper machine operated with higher adhesive add-on and a wetter sheet provided to the Yankee. Here it is seen that Yankee hood energy consumption begins at between 2.5-3 MMBtu/ton and increases to about 4 MMBtu/ton in 2½ hours or so. Note in FIG. 4, that hood energy usage exceeds 3 MMBtu/ton of sheet produced almost immediately as the production interval begins. Inasmuch as the Yankee hood requires a relatively high grade energy source, natural gas, the process of the present invention is much preferred since steam made with any fuel, including recycle fuels and is readily available in production facilities to heat the web prior to transfer to a Yankee dryer.

FIG. 5 is a similar plot for the same paper machine operated with an adhesive add-on of 20 mg/m$^2$ with a drier sheet than that used in the trials of FIG. 4 (having a sheet dryness at transfer to the Yankee similar to FIG. 1). Here it is seen that while there is benefit to drying the sheet prior to transfer to the Yankee, the results are not nearly as good as cases where lower adhesive add-on is used.

Details, including with respect to FIGS. 1-5, are further described hereinafter.

BRIEF DESCRIPTION OF DRAWINGS

The invention is described in detail with reference to the drawings wherein like numbers designate similar parts and wherein.

DETAILED DESCRIPTION

Figure 1:
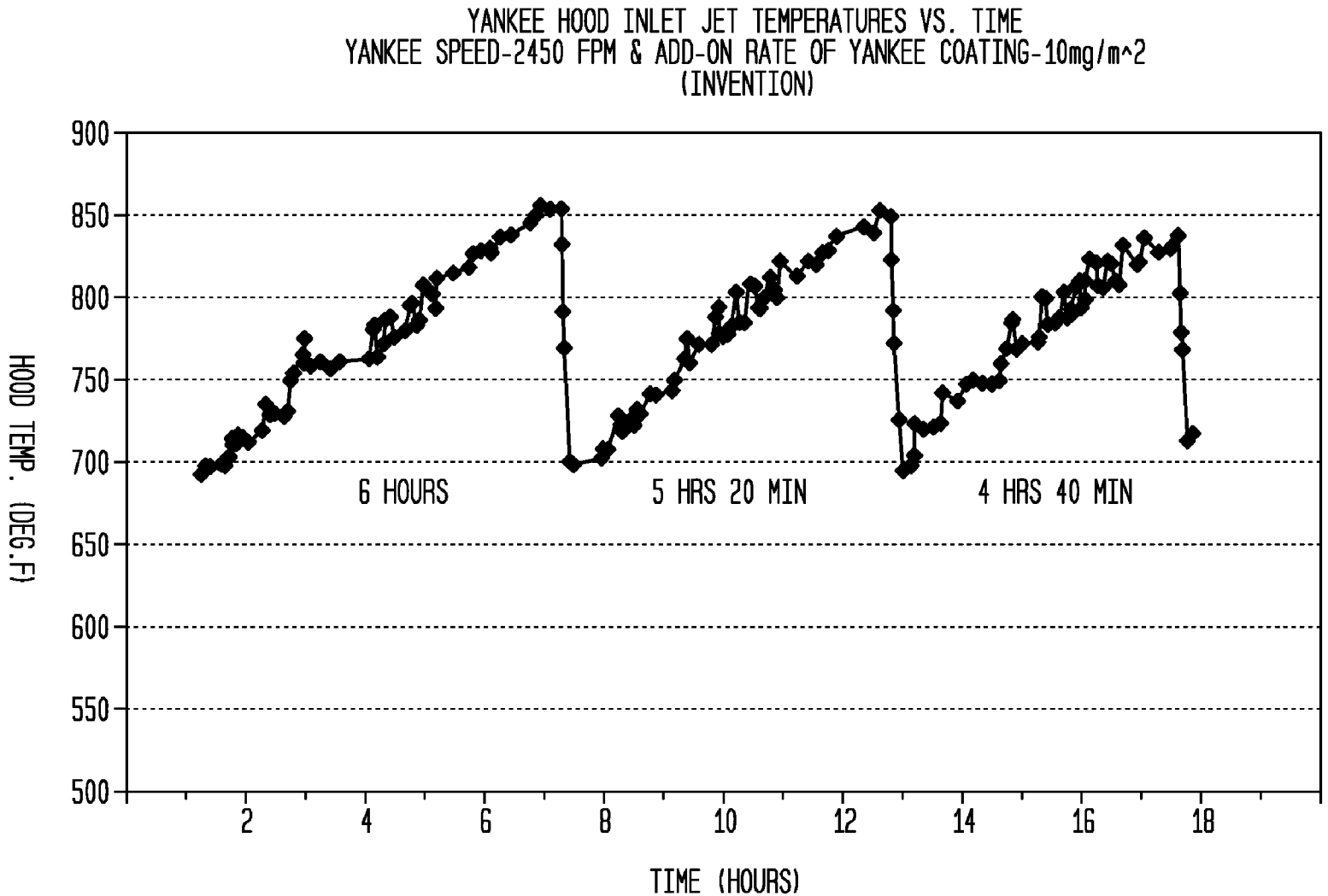
FIG. 1 is a plot of Yankee hood inlet jet temperatures versus time during operation of a high-speed, fabric-crepe paper machine, wherein the sheet was dried with high pressure stream at the creping cylinder and the Yankee was operated with low adhesive add-on in accordance with the present invention.

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art.

Terminology used herein is given its ordinary meaning consistent with the exemplary definitions set forth immediately below; mg refers to milligrams and $m^2$ refers to square meters, MM refers to million, Btu refers to British thermal units, psig refers to gauge pressure and so forth.

The creping adhesive "add-on" rate is calculated by dividing the rate of application of adhesive (mg/min) by surface area of the drying cylinder passing under a spray applicator boom ($m^2$/min). The resinous adhesive composition most preferably includes a polyvinyl alcohol resin, a polyamidoamine-epichlorohydrin resin, and a creping modifier. The add-on rate of Yankee adhesive is calculated based on solids or active ingredient content; that is, irrespective of water content. Commercial components may be purchased dry or in aqueous form and diluted with water to the desired concentration. The weight % of the various components in the adhesive resin or coating composition is likewise calculated on a dry basis.

Throughout this specification and claims, when we refer to a nascent web having an apparently random distribution of fiber orientation (or use like terminology), we are referring to the distribution of fiber orientation that results when known forming techniques are used for depositing a furnish on the forming fabric. When examined microscopically, the fibers give the appearance of being randomly oriented even though, depending on the jet to wire speed, there may be a significant bias toward machine direction orientation making the machine direction tensile strength of the web exceed the cross-direction tensile strength.

Unless otherwise specified, "basis weight", BWT, bwt and so forth refers to the weight of a 3000 square foot ream of product. Consistency refers to % solids of a nascent web, for example, calculated on a bone dry basis. "Air dry" means including residual moisture, by convention up to about 10% moisture for pulp and up to about 6% for paper. A nascent web having 50% water and 50% bone dry pulp has a consistency of 50%. 95% air-dry pulp has a consistency of 85% or more.

A characteristic operating temperature limit of a drying hood refers to the maximum inlet jet temperature of a Yankee hood, measured at the wet-end of the hood unless otherwise indicated. This may be an equipment limit or be imposed by operating considerations at the wet-end of the hood such that the product will not scorch, for example. Yankee hood temperature and characteristic operating temperature are likewise on the jet temperature at the wet-end of the hood.

As used herein, the term compactively dewatering the web or furnish refers to mechanical dewatering by wet-pressing on a dewatering felt, for example, in some embodiments by use of mechanical pressure applied continuously over the web surface as in a nip between a press roll and a press shoe wherein the web is in contact with a papermaking felt. The terminology "compactively dewatering" is used to distinguish processes wherein the initial dewatering of the web is carried out largely by thermal means as is the case, for example, in U.S. Pat. No. 4,529,480 to Trokhan and U.S. Pat. No. 5,607,551 to Farrington et al. Compactively dewatering a web thus refers, for example, to removing water from a nascent web having a consistency of less than 30% or so by application of pressure thereto and/or increasing the consistency of the web by about 15% or more by application of pressure thereto.

The terms "cellulosic", "cellulosic sheet" and the like are meant to include any product incorporating papermaking fiber having cellulose as a major constituent. "Papermaking fibers" include virgin pulps or recycle (secondary) cellulosic fibers or fiber mixes comprising cellulosic fibers. Fibers suitable for making the webs of this invention include: non-wood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood Kraft fibers; hardwood fibers, such as eucalyptus, maple, birch, aspen, or the like. Papermaking fibers can be liberated from their source material by any one of a number of chemical pulping processes familiar to one experienced in the art including sulfate, sulfite, polysulfide, soda pulping, etc. The pulp can be bleached if desired by chemical means including the use of chlorine, chlorine dioxide, oxygen, alkaline peroxide and so forth. The products of the present invention may comprise a blend of conventional fibers (whether derived from virgin pulp or recycle sources) and high coarseness lignin-rich tubular fibers, such as bleached chemical thermomechanical pulp (BCTMP). "Furnishes" and like terminology refers to aqueous compositions including papermaking fibers, optionally wet strength resins, debonders and the like for making paper products.

It has been found in accordance with the present invention that pre-dried pulps are preferred over "slush" pulps. When we refer to pre-dried pulps, we refer to pulps that are at least 80% air-dry, that is, those that have been dried to a consistency of at least 72% prior to use in the furnish supplied to the process. For present purposes, "Air-Dry" is calculated as: consistency÷90×100%. Commercial pulps which are at least 90% or 95% air-dry are preferred and may be hardwood Kraft pulps, softwood Kraft pulps, and so forth, such as Southern Softwood Kraft fiber. Suitable commercial pre-dried pulps may have a GE Brightness of at least 80, 85 or 90; in many cases, suitable pulps will have a GE Brightness between about 85 and 95. In some preferred cases, at least 60% pre-dried pulp is used while, in still others, at least 75% pre-dried pulp and more is employed. Recycle pulp may be used as desired.

Creping fabric and like terminology refers to a fabric or belt which bears a pattern suitable for practicing the process of the present invention and preferably is permeable enough such that the web may be dried while it is held in the creping fabric. In cases where the web is transferred to another fabric or surface (other than the creping fabric) for drying, the creping fabric may have lower permeability.

When referring to an adhesive coating or composition as "durable" to a specific temperature we mean that the coating or composition will not harden and remains re-wettable after being heated to that temperature.

Fpm refers to feet per minute; while fps refers to feet per second.

GE brightness is measured in accordance with TAPPI T 452 om-02. TAPPI 452 incorporates 45° illumination and 0° observation geometry.

MD means machine direction and CD means cross-machine direction.

Nip parameters include, without limitation, nip pressure, nip length, backing roll hardness, fabric approach angle, fabric takeaway angle, uniformity, and velocity delta between surfaces of the nip.

Nip width means the length over which the nip surfaces are in contact.

"Wet-tack" refers generally to the ability of an adhesive coating on a drying cylinder to adhere a wet web to the cylinder for purposes of drying the web.

"Fabric-crepe ratio" is an expression of the speed differential between the creping fabric and the forming wire and typically calculated as the ratio of the web speed immediately before fabric-creping and the web speed immediately following fabric-creping, the forming wire and transfer surface being typically, but not necessarily, operated at the same speed:

Fabric-crepe ratio=transfer cylinder speed÷creping fabric speed

Fabric-crepe can also be expressed as a percentage calculated as:

Fabric-crepe, %,=[Fabric-crepe ratio−1]×100%

A web creped from a transfer cylinder with a surface speed of 750 fpm to a fabric with a velocity of 500 fpm has a fabric-crepe ratio of 1.5 and a fabric-crepe of 50%. For reel crepe, the reel crepe ratio is calculated as the Yankee speed divided by reel speed. To express reel crepe as a percentage, 1 is subtracted from the reel crepe ratio and the result multiplied by 100%.

The total crepe ratio is calculated as the ratio of the forming wire speed to the reel speed and a % total crepe is:

Total Crepe %=[Total Crepe Ratio−1]×100%

A process with a forming wire speed of 2000 fpm and a reel speed of 1000 fpm has a line or total crepe ratio of 2 and a total crepe of 100%.

A product is considered "peeled" from a Yankee drying cylinder when removed without substantial reel crepe, under tension. Typically, a peeled product has less than 1% reel crepe.

A "production interval" refers to a period of operation, that is, steady state or quasi-steady state, during which absorbent sheet is being produced for consumption between successive cleaning or stripping operations, for example, where material is typically recycled to the process. Preferably, the production of paper product is maintained at a substantially constant rate, +/−20% of a target during a production interval.

PLI or pli means pounds force per linear inch.

Pusey and Jones (P&J) hardness (indentation) is measured in accordance with ASTM D 531, and refers to the indentation number (standard specimen and conditions).

Velocity delta means a difference in linear speed.

The resinous adhesive coating composition used to secure the web to the Yankee drying cylinder is preferably a hygroscopic, re-wettable, substantially non-crosslinking composition. Typically, the resinous adhesive coating composition includes one or more adhesive resins, a modifier and one or more additives. Examples of adhesive compositions are those which include poly(vinyl alcohol) and PAE resins of the general class described in U.S. Pat. No. 4,528,316 to Soerens et al. the disclosure of which is incorporated herein by reference. See also, U.S. Pat. Nos. 5,660,687 and 5,833,806, both to Allen et al., the disclosures of which are hereby incorporated by reference.

Polyamide adhesive resins for use in the present invention may include polyamide-epihalohydrin resins such as polyamidoamine-epichlorohydrin (PAE) resins of the same general type employed as wet strength resins. PAE resins are described, for example, in "Wet-Strength Resins and Their Applications," Ch. 2, H. Epsy entitled Alkaline-Curing Polymeric Amine-Epichlorohydrin Resins, which is incorporated herein by reference in its entirety. Suitable PAE resins for use according to the present invention include a water-soluble polymeric reaction product of an epihalohydrin, preferably epichlorohydrin, and a water-soluble polyamide having secondary amine groups derived from a polyalkylene polyamine and a saturated aliphatic dibasic carboxylic acid containing from about 3 to about 10 carbon atoms. A suitable PAE resin may be based on diethylene triamine (DETA), glutaric and/or adipic acid, and epichlorohydrin.

PAE resin compositions for use according to the present invention can be obtained from Process Applications, Ltd of Washington Crossing, Pa. and Hercules Corporation, based in Wilmington, Del. A particularly suitable PAE creping adhesive resin composition which is useful in connection with the present invention is Ultracrepe™ HT. Commercial PAE resin compositions may include other components, such as cross-linkers, additives, by-products and so forth.

The creping adhesive also preferably includes a film-forming semi-crystalline polymer. Film-forming semi-crystalline polymers for use in the present invention can be selected from, for example, hemicellulose, carboxymethyl cellulose, and most preferably includes polyvinyl alcohol (PVOH). Polyvinyl alcohols used in the creping adhesive can have an average molecular weight of about 13,000 to about 124,000 Daltons.

The polyvinyl alcohol (PVOH) resins may be based on vinyl acetate homopolymer or copolymers of vinyl acetate with any suitable comonomer and/or blends thereof. PVOH resins employed in the present invention are predominately (more than 75 mole %) based on vinyl acetate monomer which is polymerized and subsequently hydrolyzed to polyvinyl alcohol. Generally, the resins are 99 mole % or more vinyl acetate derived. If used, comonomers may be present from about 0.1 to 25 mole % with vinyl acetate and include acrylic comonomers such as AMPS or salts thereof. Other suitable comonomers include glycol comonomers, versatate comonomers, maleic or lactic acid comonomers, itaconic acid comonomers and so forth. Vinyl versatate including alkyl groups (veova) comonomers may likewise be useful. See Finch et al., *Ed. Polyvinyl Alcohol Developments* (Wiley 1992), pp. 84 and following. The comonomers may be grafted or co-polymerized with vinyl acetate as part of the backbone. Likewise, homopolymers may be blended with copolymers, if so desired.

In general, polyvinyl acetate in an alcohol solution can be converted to polyvinyl alcohol, i.e. —$OCOCH_3$ groups are replaced by —OH groups through "hydrolysis", also referred to as "alcoholysis." The degree of hydrolysis refers to the mole % of the resin's vinyl acetate monomer content that has been hydrolyzed. Methods of producing polyvinyl acetate-polyvinyl alcohol polymers and copolymers are known to those skilled in the art. U.S. Pat. Nos. 1,971,951; and 2,109,883, as well as various literature references describe these types of polymers and their preparation. Among the literature references are "Vinyl Polymerization", Vol. 1, Part 1, by Ham, published by Marcel Dekker, Inc., (1967) and "Preparative Methods of Polymer Chemistry", by Sorenson and Campbell, published by Interscience Publishers, Inc., New York (1961).

Polyvinyl alcohols for use according to the present invention include those obtainable from Monsanto Chemical Co. and Celanese Chemical. Appropriate polyvinyl alcohols from Monsanto Chemical Co. include Gelvatols, including, but not limited to, GELVATOL 1-90, GELVATOL 3-60, GELVATOL 20-30, GELVATOL 1-30, GELVATOL 20-90, and GELVATOL 20-60. Regarding the Gelvatols, the first number indicates the percentage residual polyvinyl acetate and the next series of digits when multiplied by 1,000 gives the number corresponding to the average molecular weight. Generally, polyvinyl alcohol or PVOH resins consist mostly of hydrolyzed polyvinyl acetate repeat units (more than 50 mole %), but may include monomers other than polyvinyl acetate in amounts up to about 10 mole % or so in typical commercial resins.

Celanese Chemical polyvinyl alcohol products for use in the creping adhesive (previously named Airvol products from Air Products until October 2000) are listed below:

TABLE 1

Polyvinyl Alcohol for Creping Adhesive

| Grade | % Hydrolysis, | Viscosity, cps[1] | pH | Volatiles, % Max. | Ash, % Max.[3] |
|---|---|---|---|---|---|
| | | Super Hydrolyzed | | | |
| Celvol ® 125 | 99.3+ | 28-32 | 5.5-7.5 | 5 | 1.2 |
| Celvol ® 165 | 99.3+ | 62-72 | 5.5-7.5 | 5 | 1.2 |
| | | Fully Hydrolyzed | | | |
| Celvol ® 103 | 98.0-98.8 | 3.5-4.5 | 5.0-7.0 | 5 | 1.2 |
| Celvol ® 305 | 98.0-98.8 | 4.5-5.5 | 5.0-7.0 | 5 | 1.2 |
| Celvol ® 107 | 98.0-98.8 | 5.5-6.6 | 5.0-7.0 | 5 | 1.2 |
| Celvol ® 310 | 98.0-98.8 | 9.0-11.0 | 5.0-7.0 | 5 | 1.2 |
| Celvol ® 325 | 98.0-98.8 | 28.0-32.0 | 5.0-7.0 | 5 | 1.2 |
| Celvolv 350 | 98.0-98.8 | 62-72 | 5.0-7.0 | 5 | 1.2 |
| | | Intermediate Hydrolyzed | | | |
| Celvol ® 418 | 91.0-93.0 | 14.5-19.5 | 4.5-7.0 | 5 | 0.9 |
| Celvol ® 425 | 95.5-96.5 | 27-31 | 4.5-6.5 | 5 | 0.9 |
| | | Partially Hydrolyzed | | | |
| Celvol ® 502 | 87.0-89.0 | 3.0-3.7 | 4.5-6.5 | 5 | 0.9 |
| Celvol ® 203 | 87.0-89.0 | 3.5-4.5 | 4.5-6.5 | 5 | 0.9 |
| Celvol ® 205 | 87.0-89.0 | 5.2-6.2 | 4.5-6.5 | 5 | 0.7 |
| Celvol ® 513 | 86.0-89.0 | 13-15 | 4.5-6.5 | 5 | 0.7 |
| Celvol ® 523 | 87.0-89.0 | 23-27 | 4.0-6.0 | 5 | 0.5 |
| Celvol ® 540 | 87.0-89.0 | 45-55 | 4.0-6.0 | 5 | 0.5 |

[1]4% aqueous solution, 20° C.

Creping modifiers which may be used include quaternary ammonium complexes, polyethylene glycols and so forth. Modifiers include those obtainable from Goldschmidt Corporation of Essen/Germany or Process Applications, Ltd., based in Washington Crossing, Pa. Creping modifiers from Goldschmidt Corporation include, but are not limited to, VARISOFT® 222LM, VARISOFT® 222, VARISOFT® 110, VARISOFT® 222LT, VARISOFT® 110 DEG, and VARISOFT® 238. A particularly suitable modifier is Ultra FDA GB available from Process Applications, Ltd.

Preferred resinous adhesive coating compositions used in connection with the present invention include a polyvinyl alcohol resin, a PAE resin and a modifier. A suitable PAE resin may be based on glutaric acid and DETA having a weight average molecular weight (GPC) of 150,000 or more, while the creping modifier may include imidazolinium salts and polyethylene glycols as major components. The resinous adhesive resin composition may suitably include less than 75% by weight of a polyvinyl alcohol resin, suitably between about 40% by weight and 80% by weight of the resinous adhesive coating composition. In some preferred embodiments, the resinous adhesive coating composition includes less than 60% by weight polyvinyl alcohol resin and in some embodiments, less than 50% by weight of a polyvinyl alcohol resin. Partially hydrolyzed, relatively high viscosity PVOH may be used.

The resinous adhesive coating composition also suitably includes a major portion PVOH, from about 5% by weight to about 35% by weight of a polyamidoamine composition, such as the commercially available compositions noted above. Suitable adhesive resinous compositions thus include at least 10-30% by weight of a polyamidoamine resin composition such as Ultracrepe™ HT as well as from about 2.5 weight % to about 20 weight % or 30 weight % of a modifier such as Ultra FDA GB, the balance Celvol® 523 PVOH.

In connection with the present invention, an absorbent paper web is made by dispersing papermaking fibers into aqueous furnish (slurry) and depositing the aqueous furnish onto the forming wire of a papermaking machine. Any suitable forming scheme might be used. For example, an extensive but non-exhaustive list in addition to Fourdrinier formers includes a crescent former, a C-wrap twin wire former, an S-wrap twin wire former, or a suction breast roll former. The forming fabric can be any suitable foraminous member including single layer fabrics, double layer fabrics, triple layer fabrics, photopolymer fabrics, and the like. Non-exhaustive background art in the forming fabric area includes U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,261; 5,199,467; 5,211,815; 5,219,004; 5,245,025; 5,277,761; 5,328,565; and 5,379,808 all of which are incorporated herein by reference in their entirety. One forming fabric particularly useful with the present invention is Voith Fabrics Forming Fabric 2164 made by Voith Fabrics Corporation, Shreveport, La.

The furnish may contain chemical additives to alter the physical properties of the paper produced. These chemistries are well understood by the skilled artisan and may be used in any known combination. Such additives may be surface modifiers, softeners, debonders, strength aids, latexes, opacifiers, optical brighteners, dyes, pigments, sizing agents, barrier chemicals, retention aids, insolubilizers, organic or inorganic crosslinkers, or combinations thereof, said chemicals optionally comprising polyols, starches, PPG esters, PEG esters, phospholipids, surfactants, polyamines, HMCP (Hydrophobically Modified Cationic Polymers), HMAP (Hydrophobically Modified Anionic Polymers) or the like.

The pulp can be mixed with strength adjusting agents such as wet strength agents, dry strength agents and debonders/softeners and so forth. Suitable wet strength agents are known to the skilled artisan. A comprehensive but non-exhaustive list of useful strength aids includes urea-formaldehyde resins, melamine formaldehyde resins, glyoxylated polyacrylamide resins, polyamide-epichlorohydrin resins and the like. Thermosetting polyacrylamides are produced by reacting acrylamide with diallyl dimethyl ammonium chloride (DADMAC) to produce a cationic polyacrylamide copolymer which is ultimately reacted with glyoxal to produce a cationic crosslinking wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference in their entirety. Resins of this type are commercially available under the trade name of PAREZ 631NC by Bayer Corporation. Different mole ratios of acrylamide/-

DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorohydrin wet strength resins, an example of which is sold under the trade names Kymene 557LX and Kymene 557H by Hercules Incorporated of Wilmington, Del. and Amres® from Georgia-Pacific Resins, Inc. These resins and the process for making the resins are described in U.S. Pat. No. 3,700,623 and U.S. Pat. No. 3,772,076 each of which is incorporated herein by reference in its entirety. An extensive description of polymeric-epihalohydrin resins is given in Chapter 2: *Alkaline-Curing Polymeric Amine-Epichlorohydrin* by Espy in *Wet Strength Resins and Their Application* (L. Chan, Editor, 1994), herein incorporated by reference in its entirety. A reasonably comprehensive list of wet strength resins is described by Westfelt in *Cellulose Chemistry and Technology* Volume 13, p. 813, 1979, which is incorporated herein by reference.

Suitable temporary wet strength agents may likewise be included, particularly in special applications where disposable towel with permanent wet strength resin is to be avoided. A comprehensive but non-exhaustive list of useful temporary wet strength agents includes aliphatic and aromatic aldehydes including glyoxal, malonic dialdehyde, succinic dialdehyde, glutaraldehyde and dialdehyde starches, as well as substituted or reacted starches, disaccharides, polysaccharides, chitosan, or other reacted polymeric reaction products of monomers or polymers having aldehyde groups, and optionally, nitrogen groups. Representative nitrogen containing polymers, which can suitably be reacted with the aldehyde containing monomers or polymers, includes vinyl-amides, acrylamides and related nitrogen containing polymers. These polymers impart a positive charge to the aldehyde containing reaction product. In addition, other commercially available temporary wet strength agents, such as, PAREZ 745, manufactured by Bayer can be used, along with those disclosed, for example in U.S. Pat. No. 4,605,702.

The temporary wet strength resin may be any one of a variety of water-soluble organic polymers comprising aldehydic units and cationic units used to increase dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769 and 5,217,576. Modified starches sold under the trademarks CO-BOND® 1000 and CO-BOND® 1000 Plus, by National Starch and Chemical Company of Bridgewater, N.J. may be used. Prior to use, the cationic aldehydic water soluble polymer can be prepared by preheating an aqueous slurry of approximately 5% solids maintained at a temperature of approximately 240 degrees Fahrenheit and a pH of about 2.7 for approximately 3.5 minutes. Finally, the slurry can be quenched and diluted by adding water to produce a mixture of approximately 1.0% solids at less than about 130 degrees Fahrenheit.

Other temporary wet strength agents, also available from National Starch and Chemical Company are sold under the trademarks CO-BOND® 1600 and CO-BOND® 2300. These starches are supplied as aqueous colloidal dispersions and do not require preheating prior to use.

Temporary wet strength agents such as glyoxylated polyacrylamide can be used. Temporary wet strength agents such glyoxylated polyacrylamide resins are produced by reacting acrylamide with diallyl dimethyl ammonium chloride (DADMAC) to produce a cationic polyacrylamide copolymer which is ultimately reacted with glyoxal to produce a cationic cross-linking temporary or semi-permanent wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference. Resins of this type are commercially available under the trade name of PAREZ 631NC, by Bayer Industries. Different mole ratios of acrylamide/DADMAC/glyoxal can be used to produce cross-linking resins, which are useful as wet strength agents. Furthermore, other dialdehydes can be substituted for glyoxal to produce wet strength characteristics.

Suitable dry strength agents include starch, guar gum, polyacrylamides, carboxymethyl cellulose and the like. Of particular utility is carboxymethyl cellulose, an example of which is sold under the trade name Hercules CMC, by Hercules Incorporated of Wilmington, Del. According to one embodiment, the pulp may contain from about 0 to about 15 lb/ton of dry strength agent. According to another embodiment, the pulp may contain from about 1 to about 5 lbs/ton of dry strength agent.

Suitable debonders are likewise known to the skilled artisan. Debonders or softeners may also be incorporated into the pulp or sprayed upon the web after its formation. The present invention may also be used with softener materials including but not limited to the class of amido amine salts derived from partially acid neutralized amines. Such materials are disclosed in U.S. Pat. No. 4,720,383. Evans, *Chemistry and Industry,* 5 Jul. 1969, pp. 893-903; Egan, *J. Am. Oil Chemist's Soc.*, Vol. 55 (1978), pp. 118-121; and Trivedi et al., *J. Am. Oil Chemist's Soc.*, June 1981, pp. 754-756, incorporated by reference in their entirety, indicate that softeners are often available commercially only as complex mixtures rather than as single compounds. While the following discussion will focus on the predominant species, it should be understood that commercially available mixtures would generally be used in practice.

Quasoft 202-JR is a suitable softener material, which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably 6 to 7 and most preferably 6.5 to 7.

Quaternary ammonium compounds, such as dialkyl dimethyl quaternary ammonium salts are also suitable particularly when the alkyl groups contain from about 10 to 24 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative of biodegradable softeners.

In some embodiments, a particularly preferred debonder composition includes a quaternary amine component as well as a nonionic surfactant.

The nascent web is typically dewatered on a papermaking felt. Any suitable felt may be used. For example, felts can have double-layer base weaves, triple-layer base weaves, or laminated base weaves. Preferred felts are those having the laminated base weave design. A wet-press-felt which may be particularly useful with the present invention is Vector 3 made by Voith Fabric. Background art in the press felt area includes U.S. Pat. Nos. 5,657,797; 5,368,696; 4,973,512; 5,023,132; 5,225,269; 5,182,164; 5,372,876; and 5,618,612. A differential pressing felt as is disclosed in U.S. Pat. No. 4,533,437 to Curran et al. may likewise be utilized.

Suitable creping or textured fabrics include single layer or multi-layer, or composite preferably open meshed structures. Fabric construction per se is of less importance than the topography of the creping surface in the creping nip as discussed in more detail below. Long MD knuckles with slightly lowered CD knuckles are greatly preferred for some products. Fabrics may have at least one of the following characteristics: (1) on the side of the creping fabric that is in contact with the wet web (the "top" side), the number of machine direction (MD) strands per inch (mesh) is from 10 to 200 and the number of cross-direction (CD) strands per inch (count) is also from 10 to 200; (2) the strand diameter is typically smaller than 0.050 inch; (3) on the top side, the distance between the highest point of the MD knuckles and the highest point on the CD knuckles is from about 0.001 to about 0.02 or 0.03 inch; (4) in between these two levels there can be knuckles formed either by MD or CD strands that give the topography a three dimensional hill/valley appearance which is imparted to the sheet; (5) the fabric may be oriented in any suitable way so as to achieve the desired effect on processing and on properties in the product; the long warp knuckles may be on the top side to increase MD ridges in the product, or the long shute knuckles may be on the top side if more CD ridges are desired to influence creping characteristics as the web is transferred from the backing cylinder to the creping fabric; and (6) the fabric may be made to show certain geometric patterns that are pleasing to the eye, which is typically repeated between every two to 50 warp yarns. One preferred fabric is a W013 Albany International multilayer fabric. Such fabrics are formed from monofilament polymeric fibers having diameters typically ranging from about 0.25 mm to about 1 mm. Such fabrics are formed from monofilament polymeric fibers having diameters typically ranging from about 10 mm to about 100 mm. This fabric may be used to produce an absorbent cellulosic sheet having variable local basis weight comprising a papermaking fiber reticulum provided with (i) a plurality of cross-machine direction (CD) extending, fiber-enriched pileated regions of relatively high local basis weight interconnected by (ii) a plurality of elongated densified regions of compressed papermaking fibers, the elongated densified regions having relatively low local basis weight and are generally oriented along the machine direction (MD) of the sheet. The elongated densified regions are further characterized by an MD/CD aspect ratio of at least 1.5. Typically, the MD/CD aspect ratios of the densified regions are greater than 2 or greater than 3; generally between about 2 and 10. In most cases the fiber-enriched, pileated regions have fiber orientation bias along the CD of the sheet and the densified regions of relatively low basis weight extend in the machine direction and also have fiber orientation bias along the CD of the sheet. This product is further described in copending application U.S. Application Ser. No. 60/808,863, entitled "Fabric Creped Absorbent Sheet with Variable Local Basis Weight", filed May 26, 2006, GP-06-11), the disclosure of which is incorporated herein in its entirety by reference.

The creping fabric may be of the class described in U.S. Pat. No. 5,607,551 to Farrington et al., Cols. 7-8 thereof, as well as the fabrics described in U.S. Pat. No. 4,239,065 to Trokhan and U.S. Pat. No. 3,974,025 to Ayers. Such fabrics may have about 20 to about 60 meshes per inch and are formed from monofilament polymeric fibers having diameters typically ranging from about 0.008 to about 0.025 inches. Both warp and weft monofilaments may, but need not necessarily be of the same diameter.

In some cases the filaments are so woven and complimentarily serpentinely configured in at least the Z-direction (the thickness of the fabric) to provide a first grouping or array of coplanar top-surface-plane crossovers of both sets of filaments; and a predetermined second grouping or array of sub-top-surface crossovers. The arrays are interspersed so that portions of the top-surface-plane crossovers define an array of wicker-basket-like cavities in the top surface of the fabric which cavities are disposed in staggered relation in both the machine direction (MD) and the cross-machine direction (CD), and so that each cavity spans at least one sub-top-surface crossover. The cavities are discretely perimetrically enclosed in the plan view by a picket-like-lineament comprising portions of a plurality of the top-surface plane crossovers. The loop of fabric may comprise heat set monofilaments of thermoplastic material; the top surfaces of the coplanar top-surface-plane crossovers may be monoplanar flat surfaces. Specific embodiments of the invention include satin weaves as well as hybrid weaves of three or greater sheds, and mesh counts of from about 10×10 to about 120×120 filaments per inch (4×4 to about 47×47 per centimeter). Although the preferred range of mesh counts is from about 18 by 16 to about 55 by 48 filaments per inch (9×8 to about 22×19 per centimeter).

Instead of an impression fabric, a dryer fabric may be used as the creping fabric if so desired. Suitable fabrics are described in U.S. Pat. No. 5,449,026 (woven style) and U.S. Pat. No. 5,690,149 (stacked MD tape yarn style) to Lee as well as U.S. Pat. No. 4,490,925 to Smith (spiral style).

If a Fourdrinier former or other gap former is used, the nascent web may be conditioned with suction boxes and a steam shroud until it reaches a solids content suitable for transferring to a dewatering felt. The nascent web may be transferred with suction assistance to the felt. In a crescent former, use of suction assist is unnecessary as the nascent web is formed between the forming fabric and the felt.

Figure 6:
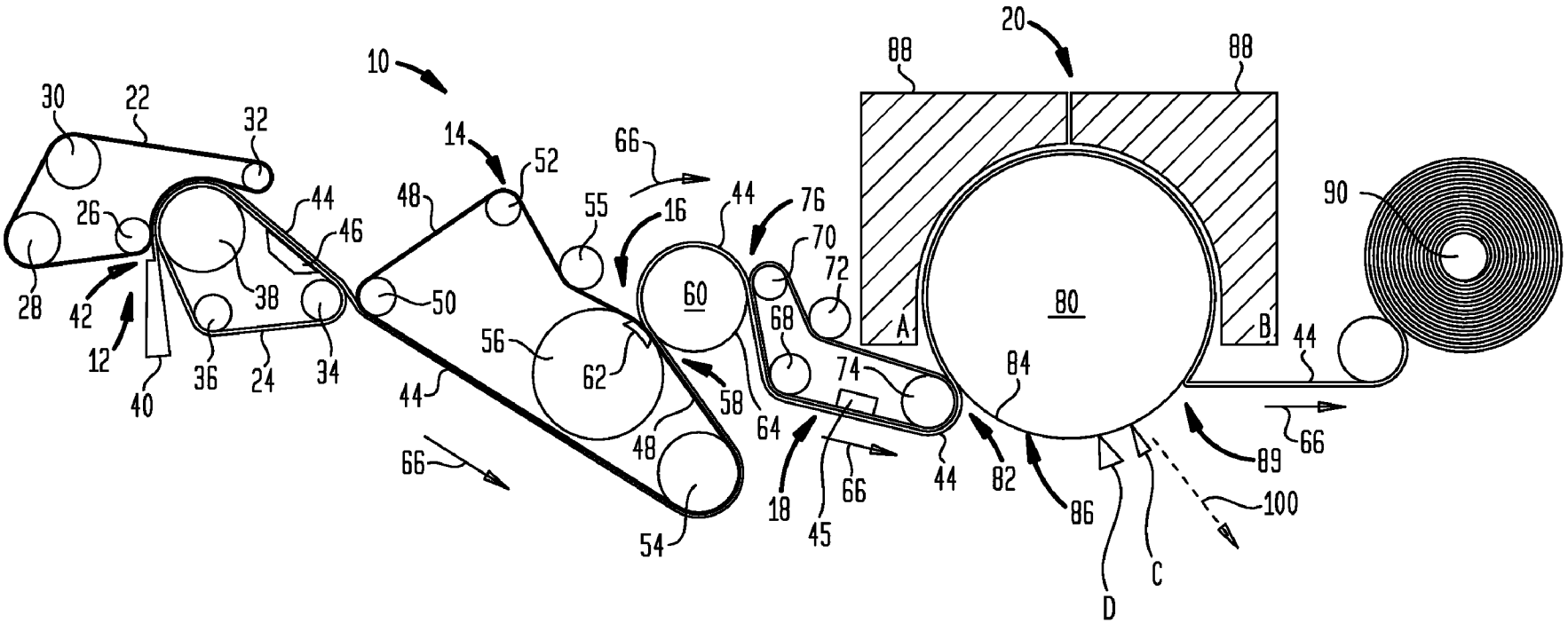
FIG. 6 is a schematic diagram of a first paper machine suitable for practicing the process of the present invention.

FIG. 6 is a schematic diagram of a paper machine 10 having a conventional twin wire forming section 12, a felt run 14, a shoe press section 16 a creping fabric 18 and a Yankee dryer 20 suitable for practicing the present invention. Forming section 12 includes a pair of forming fabrics 22, 24 supported by a plurality of rolls 26, 28, 30, 32, 34, 36 and a forming roll 38. A headbox 40 provides papermaking furnish issuing therefrom as a jet in the machine direction to a nip 42 between forming roll 38 and roll 26 and the fabrics. The furnish forms a nascent web 44 which is dewatered on the fabrics with the assistance of suction, for example, by way of suction box 46.

The nascent web is advanced to a papermaking felt 48 which is supported by a plurality of rolls 50, 52, 54, 55 and the felt is in contact with a shoe press roll 56 which has a shoe 62. The web is of low consistency as it is transferred to the felt. Transfer may be assisted by suction; for example roll 50 may be a suction roll if so desired or a pickup or vacuum shoe as is known in the art. As the web reaches the shoe press roll it may have a consistency of 10-25%, preferably 20 to 25% or so as it enters nip 58 between shoe press roll 56 and transfer roll 60.

Transfer or backing roll 60 is heated with steam. It has been found that increasing steam pressure to roll 60 helps lengthen the time between required stripping of excess adhesive from the cylinder of Yankee dryer 20. Suitable steam pressure may be about 95 psig or so, bearing in mind that roll 60 is a crowned roll and roll 70 has a negative crown to match such that the contact area between the rolls is influenced by the pressure in roll 60. Thus, care must be exercised to maintain matching contact between rolls 60, 70 when elevated pressure is employed.

Instead of a shoe press roll, roll 56 could be a conventional suction pressure roll. If a shoe press is employed, it is desirable and preferred that roll 54 is a vacuum roll effective to remove water from the felt prior to the felt entering the shoe press nip since water from the furnish will be pressed into the felt in the shoe press nip. In any case, using a vacuum roll at 54 is typically desirable to ensure the web remains in contact with the felt during the direction change as one of skill in the art will appreciate from the diagram.

Web 44 is wet-pressed on the felt in nip 58 with the assistance of pressure shoe 62. The web is thus compactively dewatered at nip 58, typically by increasing the consistency by 15 or more points at this stage of the process. The configuration shown at nip 58 is generally termed a shoe press; in connection with the present invention, cylinder 60 is operative as a transfer cylinder which operates to convey web 44 at high speed, typically 1000 fpm-6000 fpm, to the creping fabric.

Cylinder 60 has a smooth surface 64 which may be provided with adhesive (the same as the creping adhesive used on the Yankee cylinder) and/or release agents if needed. Web 44 is adhered to transfer surface 64 of cylinder 60 which is rotating at a high angular velocity as the web continues to advance in the machine-direction indicated by arrows 66. On the cylinder, web 44 has a generally random apparent distribution of fiber.

Direction 66 is referred to as the machine-direction (MD) of the web as well as that of paper machine 10; whereas the cross-machine-direction (CD) is the direction in the plane of the web perpendicular to the MD.

Web 44 enters nip 58 typically at consistencies of 10-25% or so and is dewatered and dried to consistencies of from about 25 to about 70 by the time it is transferred to creping fabric 18 as shown in the diagram.

Fabric 18 is supported on a plurality of rolls 68, 70, 72 and a press nip roll 74 and forms a fabric-crepe nip 76 with transfer cylinder 60 as shown.

The creping fabric defines a creping nip over the distance or width in which creping fabric 18 is adapted to contact roll 60; that is, applies significant pressure to the web against the transfer cylinder. To this end, backing (or creping) roll 70 may be provided with a soft deformable surface which will increase the width of the creping nip and increase the fabric-creping angle between the fabric and the sheet and the point of contact or a shoe press roll could be used as roll 70 to increase effective contact with the web in high impact fabric-creping nip 76 where web 44 is transferred to fabric 18 and advanced in the machine-direction.

Creping nip 76 generally extends over a fabric-creping nip width of anywhere from about ⅛" to about 2", typically ½" to 2". For a creping fabric with 32 CD strands per inch, web 44 thus will encounter anywhere from about 4 to 64 weft filaments in the nip.

The nip pressure in nip 76, that is, the loading between backing roll 70 and transfer roll 60 is suitably 20-200, preferably 40-70 pounds per linear inch (PLI).

After fabric-creping, the web continues to advance along MD 66 where it is wet-pressed onto Yankee cylinder 80 in transfer nip 82. Optionally, suction is applied to the web by way of a suction box 45.

Transfer at nip 82 occurs at a web consistency of generally from about 25 to about 70%. At these consistencies, it is difficult to adhere the web to surface 84 of cylinder 80 firmly enough to remove the web from the fabric thoroughly. This aspect of the process is important, particularly when it is desired to use a high velocity drying hood.

The use of particular adhesives cooperate with a moderately moist web (25-70% consistency) to adhere it to the Yankee sufficiently to allow for high velocity operation of the system and high jet velocity impingement air drying and subsequent peeling of the web from the Yankee. In this connection, a poly(vinyl alcohol)/polyamidoamine adhesive composition is applied at surface 86 as needed, preferably at a rate of less than about 20 mg/m$^2$ of sheet. One or more spray booms may be employed.

The web is dried on Yankee cylinder 80 which is a heated cylinder and by high jet velocity impingement air in Yankee hood 88. Hood 88 is capable of variable temperature. During operation, temperature may be monitored at wet end A of the Hood (at or near the point at which the wet web enters) and dry end B of the hood (at or near the point at which the wet web exits) using an infra-red detector or any other suitable means if so desired. As the cylinder rotates, web 44 is peeled from the cylinder at 89 and wound on a take-up reel 90. Reel 90 may be operated 5-30 fpm (preferably 10-20 fpm) faster than the Yankee cylinder at steady-state when the line speed is 2100 fpm, for example. A creping doctor C is normally used and a cleaning doctor D mounted for intermittent engagement is used to control build up. When adhesive build-up is being stripped from Yankee cylinder 80, the web is typically segregated from the product on reel 90, preferably being fed to a broke chute at 100, for recycle to the production process.

Instead of being peeled from cylinder 80 at 89 during steady-state operation as shown, the web may be creped from dryer cylinder 80 using a creping doctor such as creping doctor C, if so desired.

Figure 7:
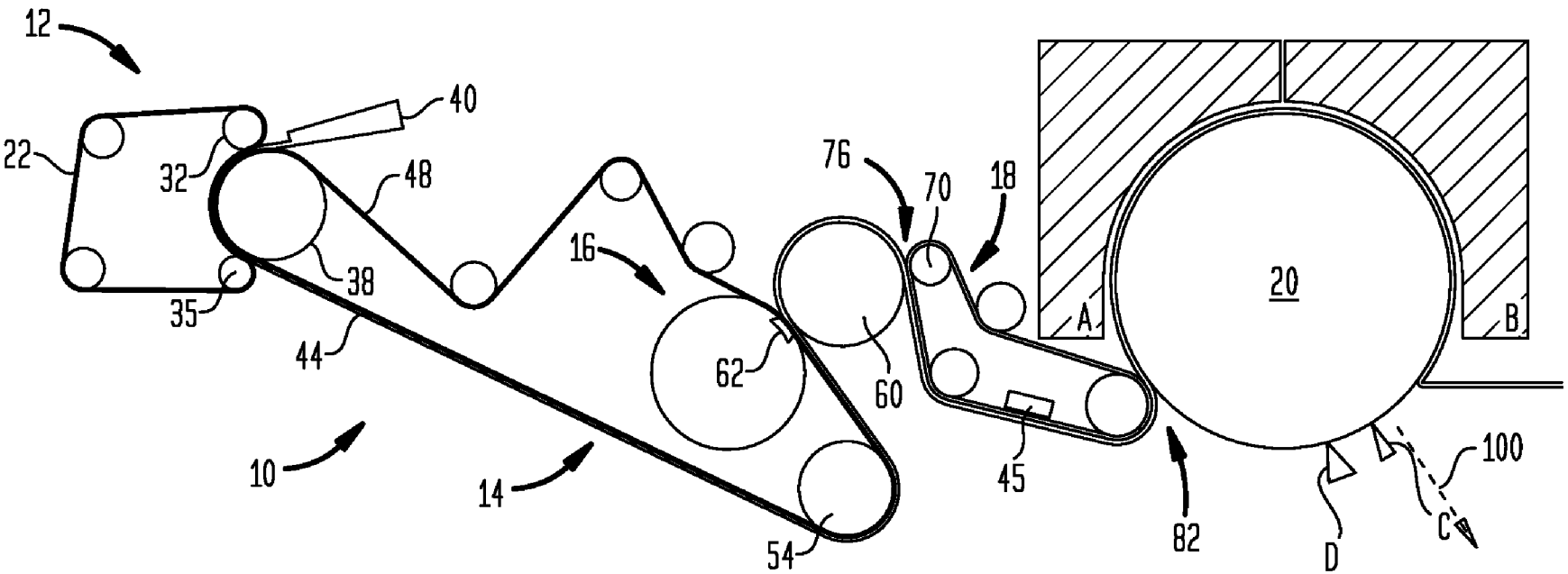
FIG. 7 is a schematic diagram of a second paper machine suitable for practicing the present invention.

There is shown schematically in FIG. 7 another paper machine 10 which may be used in connection with the present invention. Paper machine 10 is a three fabric loop machine having a forming section 12 generally referred to in the art as a crescent former. Forming section 12 includes a forming wire 22 supported by a plurality of rolls such as rolls 32, 35. The forming section also includes a forming roll 38 which supports paper making felt 48 such that web 44 is formed directly on felt 48. Felt run 14 extends to a shoe press section 16 wherein the moist web is deposited on a transfer roll 60 as described above. Thereafter, web 44 is creped onto fabric in fabric-crepe nip between rolls 60, 70 before being deposited on Yankee dryer 20 in another press nip 82. Suction is optionally applied by suction box 45 as the web is held in fabric in order to conform to the web to the textured fabric. Headbox 40 and press shoe 62 operate as noted above in connection with FIG. 1. The system includes a vacuum turning roll 54, in some embodiments; however, the three loop system may be configured in a variety of ways wherein a turning roll is not necessary.

Between the Yankee dryer and reel 90 there is provided a Measurex® control instrument to measure consistency and basis weight in order to provide data for feedback control of the paper machine. Further details are also seen in the following co-pending applications: U.S. patent application Ser. No. 11/151,761, filed Jun. 14, 2005, entitled "High Solids Fabric-crepe Process for Producing Absorbent Sheet with In-Fabric Drying"; GP-03-35); U.S. patent application Ser. No. 11/402,609, filed Apr. 12, 2006, entitled "Multi-Ply Paper Towel With Absorbent Core"; GP-04-11); U.S. patent application Ser. No. 11/451,112, filed Jun. 12, 2006, entitled "Fabric-Creped Sheet for Dispensers"; GP-06-12); U.S. Provisional Patent Application Ser. No. 60/808,863, filed May 26, 2006, entitled "Fabric-creped Absorbent Sheet with Variable Local Basis Weight"; GP-06-11); and U.S. application Ser. No. 10/679,862, filed Oct. 6, 2003, entitled "Fabric-crepe Process for Making Absorbent Sheet"; GP-02-12) which applications, incorporated herein by reference, disclose particular paper machine details as well as creping techniques, equipment and properties; U.S. application Ser. No. 11/108,375, filed Apr. 18, 2005, entitled "Fabric-crepe/Draw Process for Producing Absorbent Sheet"; GP-02-12-1) also incorporated herein by reference, provides still further processing and composition information; U.S. application Ser. No. 11/108,458, filed Apr. 18, 2005, entitled "Fabric-crepe and In Fabric Drying Process for Producing Absorbent Sheet"; GP-03-33-1) and U.S. application Ser. No. 11/104,014, filed Apr. 12, 2005, entitled "Wet-Pressed Tissue and Towel Products With Elevated CD Stretch and Low Tensile Ratios Made With a High Solids Fabric-crepe Process"; GP-04-5) both of which are incorporated herein by reference, provide some further variation as to selection of components and processing techniques. Another copending application, U.S. Ser. No. 11/451,111, filed Jun. 12, 2006, entitled "Method of Making Fabric-creped Sheet for Dispensers"; GP-05-10), incorporated herein by reference, provides information on suitable drying and other manufacturing techniques.

Preferably, the methodology employed includes: a) compactively dewatering a papermaking furnish to form a nascent web having an apparently random distribution of papermaking fiber; b) applying the dewatered web having the apparently random fiber distribution to a translating transfer surface moving at a first speed; and c) fabric-creping the web from the transfer surface at a consistency of from about 30% to about 60%, the creping step occurring under pressure in a fabric creping nip defined between the transfer surface and the creping fabric wherein the fabric is traveling at a second speed slower than the speed of said transfer surface, the fabric pattern, nip parameters, velocity delta and web consistency being selected such that the web is creped from the transfer surface and redistributed on the creping fabric to form a web with an optionally drawable reticulum having a plurality of interconnected regions of different local basis weights including at least (i) a plurality of fiber-enriched regions of high local basis weight, interconnected by way of (ii) a plurality of optionally elongated densified regions of compressed papermaking fibers, the densified regions having relatively low local basis weight and preferably being generally oriented along the machine direction (MD) of the sheet. In one preferred embodiment, the elongated densified regions are further characterized by an MD/CD aspect ratio of at least 1.5.

Various features and operating parameters of the present invention are summarized in Table 2 below.

TABLE 2

| | Operating Features | |
|---|---|---|
| Operating Feature | Typical Range(s) | Preferred Range(s) |
| Adhesive Composition Add-On to Yankee Cylinder (mg/m$^2$) | 5-25; 5-50; <20 | <15; <10; 5-15 |

TABLE 2-continued

| | Operating Features | |
|---|---|---|
| Operating Feature | Typical Range(s) | Preferred Range(s) |
| Production Interval Between Successive Stripping of Coating From Yankee Cylinder (hours) | 5-15 | >8 |
| Average Air Jet Inlet Temperature to Yankee Hood (° F.) | <850 | 600-800; optionally up to 850 |
| Durability Temperature Limit of Coating Composition (° F.) | 240-300 | 300 |
| Final Sheet Dryness (%) | 90-99 | >95; >92.5 |
| Fabric-Crepe (%) | 2-50 | 2-20 |
| Reel Crepe (%) | 0-25 | 2-15; 2.5-20 |
| Shoe-Press Pressure to Backing Roll (PLI) | 500-800 | >600; 675-775; >650 |
| Backing Roll Saturated Steam Pressure (psig) | 50-150; >60; 80-150 | >75; >90; 90-110 |
| Yankee Cylinder Saturated Steam Pressure (psig) | 75-150 | 90-125 |
| Production Rate (FPM) | >2000 | >2250; ≧2500 |

EXAMPLES

Utilizing a paper machine of the class shown in FIGS. 6 and 7, a series of trials were performed manufacturing absorbent basesheet on a commercial paper machine. Typical conditions appear in Table 2, above. Creping adhesive compositions were used which included commercial polyamidoamine resin compositions, a commercial polyvinyl alcohol resin and commercial creping modifier compositions. Typical resinous creping compositions included 60-70% by weight PVOH, 25-35% by weight PAE resin composition and 5-20% by weight creping modifier. The resin composition selected must be effective to transfer the web from the creping fabric to the Yankee cylinder at the add-on levels employed. The more salient features and results are presented in FIGS. 1-5.

FIG. 1 is a plot of hood temperature versus time for three production intervals on a commercial paper machine. The machine was operated at 2,450 fpm with an add-on rate of Yankee creping adhesive of 10 mg/m$^2$. The backing cylinder 60 was supplied with relatively high pressure steam (about 95 psig) during these trials to dry the sheet prior to Yankee transfer. During the various production campaigns shown in FIG. 1, it was seen that the rate of increase of hood temperature was kept relatively low, about <0.5° F./min. This enabled operation of the machine for six hours or so until the operating temperature limit of the Yankee dryer, about 850° F. was reached.

Figure 2:
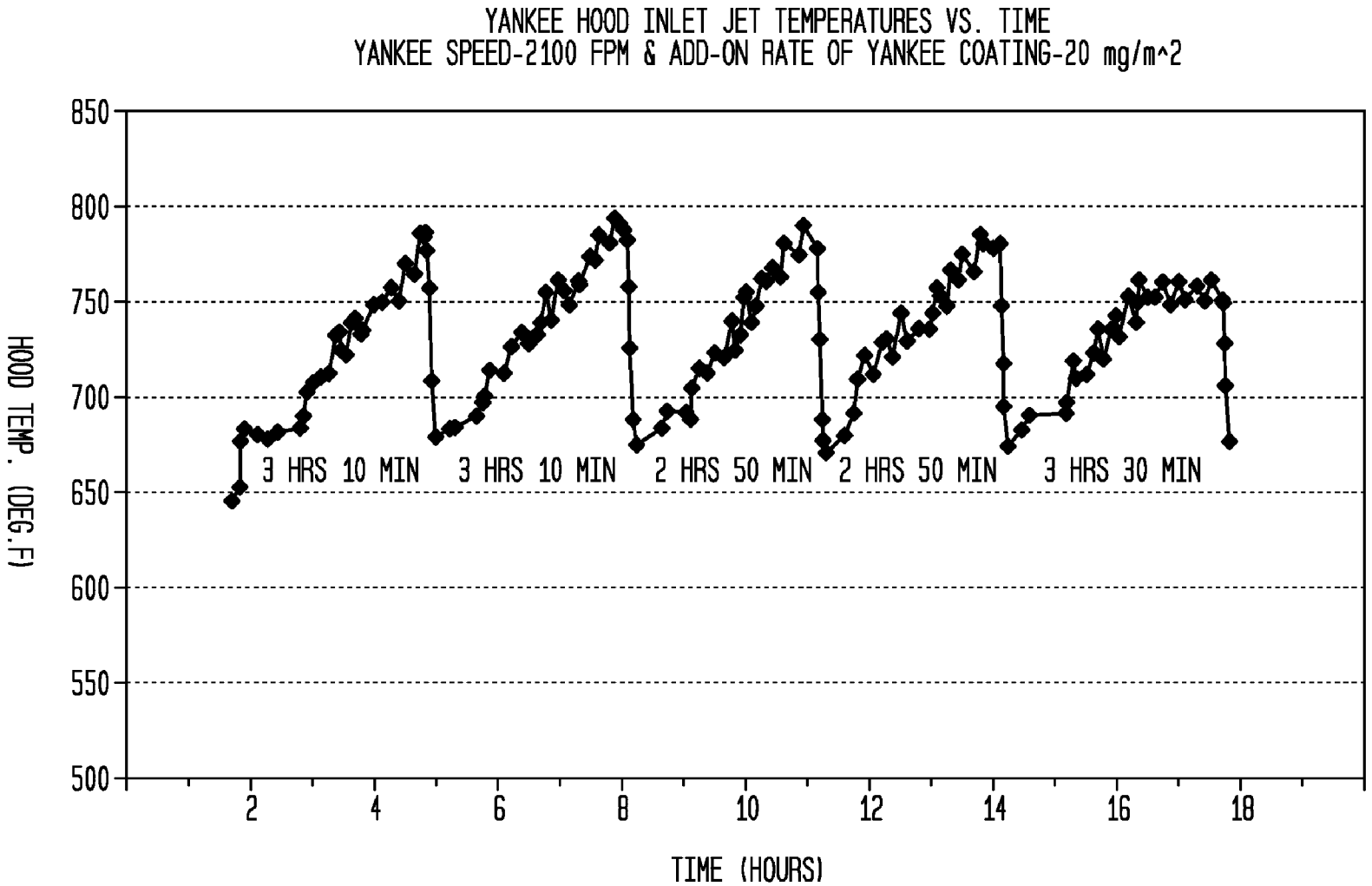
FIG. 2 is a plot of Yankee hood inlet jet temperatures versus time during operation of a high-speed, fabric-crepe paper machine, wherein the sheet was dried with high pressure stream at the creping cylinder and the Yankee was operated with twice the adhesive add-on as compared with the process of FIG. 1.

FIG. 2 is a plot of hood temperature versus time for multiple production intervals on the same machine operated at a slightly lower speed and a higher add-on rate of Yankee adhesive coating—20 mg/m$^2$. In FIG. 2, it is seen that the rate of increase of temperature with time is much greater than is seen in FIG. 1. The temperature increased in the various production runs about 1° F./min and more during the various production intervals shown in FIG. 2. In these trials, high pressure steam (95, psig) was supplied to backing cylinder 60 and it was possible to operate the machine for three hours or more when providing such additional heating to the upstream backing cylinder, that is, prior to transfer to the Yankee cylinder.

However, it is seen by comparing FIGS. 1 and 2, much better results are achieved with a lower Yankee creping adhesive add-on rate.

Figure 3:
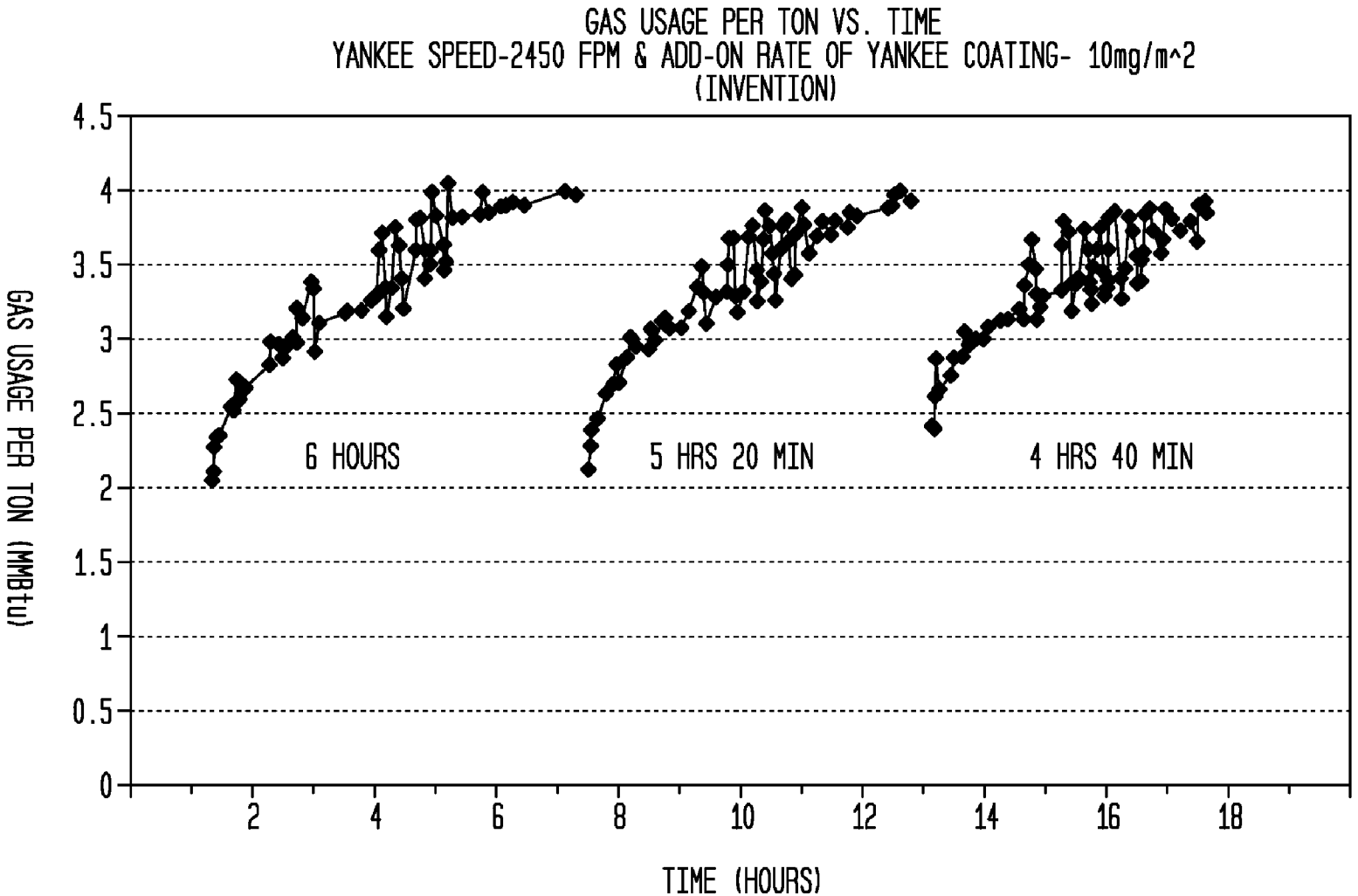
FIG. 3 is a plot of Yankee hood gas usage versus time for the process of FIG. 1.

This latter point is further illustrated. FIG. 3 is a plot of gas usage per ton (MMBtu) of the Yankee dryer hood versus time for the production runs discussed above in connection with FIG. 1. It is seen in FIG. 3 that the gas usage per ton is quite low at the beginning of a production interval, around 2 MMBtu/ton. Moreover, the gas usage per ton of the Yankee hood remains below 3 MMBtu/ton for extended periods of time during a production interval, generally for more than one hour and up to an hour and a half or two hours in some cases.

Figure 4:
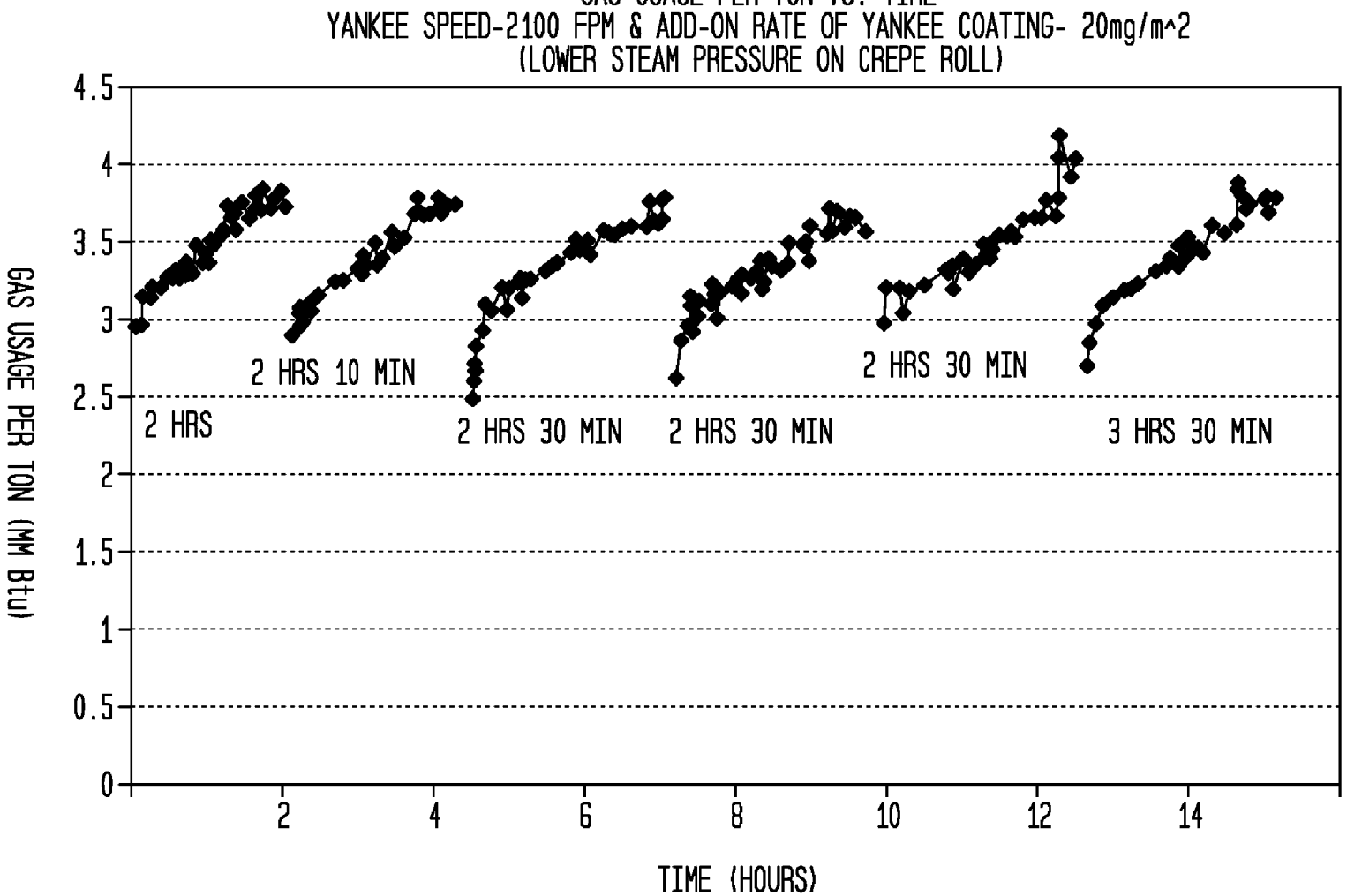
FIG. 4 is a plot of Yankee hood gas usage versus time for a process utilizing twice as much creping adhesive as compared with the process of FIG. 1 and wherein the backing cylinder was provided with steam at lower pressure.

FIG. 4 is a plot similar to FIG. 3, wherein the paper machine was operated at a slightly lower production speed with an add-on rate of Yankee creping adhesive coating of 20 mg/m$^2$. During the trials illustrated in FIG. 4, lower pressure steam, about 55 psig, was supplied to backing cylinder 60. It is seen in FIG. 4 that the Yankee hood energy usage is much higher at the beginning of a production run, typically close to 3 MMBtu/ton and increases rather rapidly.

Figure 5:
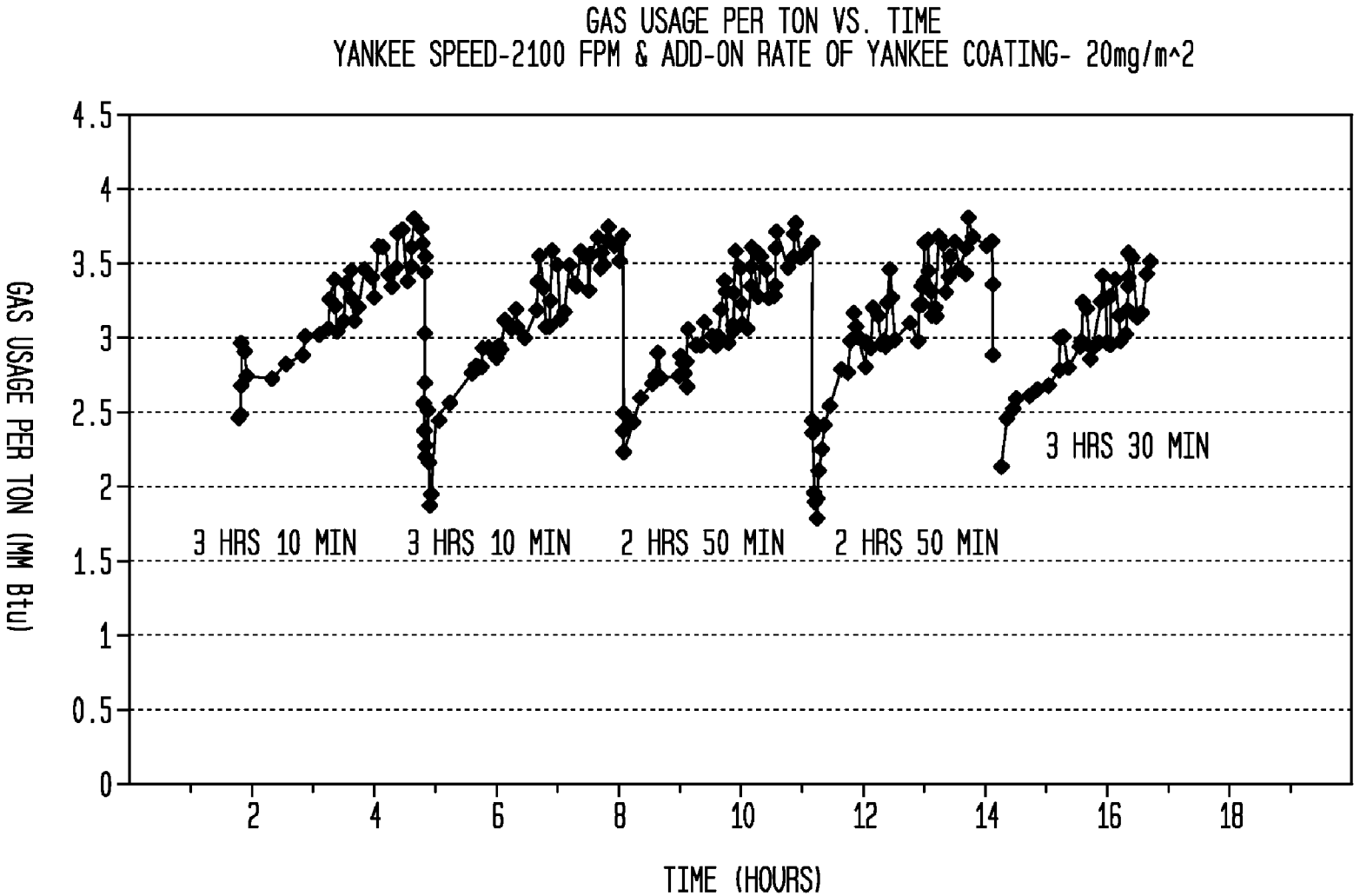
FIG. 5 is a plot of Yankee hood gas usage versus time for a process utilizing twice as much creping adhesive as compared with the process of FIG. 1 and wherein the backing cylinder was provided with high pressure steam as in FIG. 1.

FIG. 5 is a plot of Yankee hood gas usage per ton at a production rate similar to FIG. 4, wherein the Yankee coating was also applied at 20 mg/m$^2$. The production runs of FIG. 5 differ from those of FIG. 4 in that a heated backing cylinder was provided with high pressure steam (about 95 psig) as opposed to low pressure steam, about 55 psig. It is seen in FIG. 5 that the elevated steam pressure or additional drying, prior to transfer the Yankee resulted in lower initial gas usage by the Yankee hood. Typically, the production runs in FIG. 5 initially used less than 2.5 MMBtu/ton of energy by the hood at the start of a production run. While FIG. 5 shows substantially improved results as compared with FIG. 4, a comparison of FIG. 3 with FIG. 5 reveals that lowering adhesive add-on to the Yankee and increasing drying prior to transfer of the web to the Yankee cylinder provides vastly improved results.

While the invention has been described in detail, modifications within the spirit and scope of the invention will be readily apparent to those of skill in the art. In view of the foregoing discussion, relevant knowledge in the art and references including co-pending applications discussed above in connection with the Background and Detailed Description, the disclosures of which are all incorporated herein by reference, further description is deemed unnecessary.

What is claimed is:

1. A method of making a fabric-creped absorbent cellulosic sheet comprising:

(a) compactively dewatering a papermaking furnish to form a cellulosic web and concurrently applying the web to a heated rotating backing cylinder;

(b) fabric-creping the web from the heated backing cylinder surface at a consistency of from about 30% to about 60% utilizing a patterned creping fabric, the creping step occurring under pressure in a fabric-creping nip defined between the backing cylinder surface and the creping fabric wherein the fabric is traveling at a second speed slower than the speed of said backing cylinder surface, the fabric pattern, nip parameters, velocity delta and web consistency being selected such that the web is creped from the backing cylinder surface and transferred into the creping fabric;

(c) providing a hygroscopic, re-wettable resinous adhesive coating composition comprising a polyvinyl alcohol to a surface of a heated drying cylinder of a Yankee dryer at an add-on rate of less than 20 mg/m$^2$ of drying cylinder surface such that a resinous adhesive coating is formed, the Yankee dryer also having a dryer hood with a characteristic operating temperature limit;

(d) transferring the web from the creping fabric to the surface of the heated drying cylinder of the Yankee dryer such that the web is adhered to the drying cylinder by the resinous adhesive coating;

(e) drying the web on the surface of the drying cylinder;

(f) removing the dried web from the drying cylinder surface; and (g) periodically stripping at least a portion of the resinous adhesive coating from the drying cylinder surface as the characteristic operating temperature limit of the drying hood of the Yankee dryer is approached;

wherein the furnish and resinous adhesive coating composition are selected and heating of the backing cylinder and drying cylinder is controlled such that a production interval between successive strippings of adhesive coating from the drying cylinder has a duration of at least 4 hours, and during which production interval a predetermined target production rate of dried sheet is met.

2. The method according to claim 1, wherein the add-on rate of resinous adhesive coating composition to the drying cylinder is less than 15 mg/m$^2$ of drying cylinder surface.

3. The method according to claim 1, wherein the add-on rate of resinous adhesive coating composition to the drying cylinder is less than 10 mg/m$^2$ of drying cylinder surface.

4. The method according to claim 1, wherein the add-on rate of resinous adhesive coating composition to the drying cylinder is from about 5 mg/m$^2$ of drying cylinder surface to about 15 mg/m$^2$ of drying cylinder surface.

5. The method according to claim 1, wherein the production interval between successive strippings of adhesive coating from the drying cylinder is from about 5 hours to about 15 hours.

6. The method according to claim 1, wherein the production interval between successive strippings of adhesive coating from the drying cylinder is at least about 5 hours.

7. The method according to claim 1, wherein the production interval between successive strippings of adhesive coating from the drying cylinder is at least about 7 hours.

8. The method according to claim 1, wherein the production interval between successive strippings of adhesive coating from the drying cylinder is at least about 10 hours.

9. The method according to claim 1, wherein the characteristic operating drying temperature limit of the drying hood is about 850° F. or less.

10. The method according to claim 1, wherein the drying hood is operated at an average air jet inlet temperature of from about 600° F. to about 850° F. during the production interval.

11. The method according to claim 1, wherein the resinous adhesive coating composition is durable up to a temperature of at least 240° F.

12. The method according to claim 1, wherein the resinous adhesive coating composition is durable up to a temperature of at least 300° F.

13. The method according to claim 1, wherein the dried sheet is removed from the drying cylinder at a sheet temperature of from about 240° F. to about 300° F.

14. The method according to claim 1, wherein the web is dried to a consistency of at least 90% prior to removal from the drying cylinder.

15. The method according to claim 1, wherein the web is dried to a consistency of at least 92.5% prior to removal from the drying cylinder.

16. The method according to claim 1, wherein the dried web is peeled from the drying cylinder surface.

17. The method according to claim 1, wherein the dried web is creped from the drying cylinder surface at a Reel Crepe of from about 2.5% to about 20%.

18. The method according to claim 1, wherein the web is transferred to the backing cylinder in a shoe press utilizing a pressure of more than 650 PLI.

19. The method according to claim 1, wherein the web is transferred to the backing cylinder in a shoe press utilizing a pressure of more than 700 PLI.

20. The method according to claim 1, wherein the web is transferred to the backing cylinder in a shoe press utilizing a pressure of from about 675 PLI to about 775 PLI.

21. The method according to claim 1, wherein the backing roll is heated with steam at a pressure of more than 60 psig.

22. The method according to claim 1, wherein the backing roll is heated with steam at a pressure of more than 75 psig.

23. The method according to claim 1, wherein the backing roll is heated with steam at a pressure of more than 90 psig.

24. The method according to claim 1, wherein the backing roll is heated with steam at a pressure of from about 80 psig to about 150 psig.

25. The method according to claim 1, wherein the Yankee drying cylinder is heated with steam at a pressure of from about 90 psig to about 110 psig.

26. The method according to claim 1, wherein dried sheet production is substantially constant during a production interval between successive strippings of adhesive coating form the drying cylinder.

27. The method according to claim 1, wherein the target production of dried sheet is at least 2000 fpm.

28. The method according to claim 1, wherein the target production of dried sheet is at least 2250 fpm.

29. The method according to claim 1, wherein the target production of dried sheet is at least 2500 fpm.

30. A method of making a fabric-creped absorbent cellulosic sheet comprising:

(a) compactively dewatering a papermaking furnish to form a web and concurrently applying the web to a heated rotating backing cylinder;

(b) fabric-creping the web from the backing cylinder surface at a consistency of from about 30% to about 60% utilizing a patterned creping fabric, the creping step occurring under pressure in a fabric-creping nip defined between the backing cylinder surface and the creping fabric wherein the fabric is traveling at a second speed slower than the speed of said backing cylinder surface, the fabric pattern, nip parameters, velocity delta and web consistency being selected such that the web is creped from the backing cylinder surface and transferred into the creping fabric;

(c) providing a hygroscopic, re-wettable resinous adhesive coating composition comprising a polyvinyl alcohol to a surface of a heated drying cylinder of a Yankee dryer at an add-on rate of about 15 $mg/m^2$ of drying cylinder surface or less such that a resinous adhesive coating is formed, the Yankee dryer also having a dryer hood configured to provide drying energy to the web on the Yankee drying cylinder in the form of a heated air stream, the hood having a characteristic operating temperature and a characteristic operating temperature limit;

(d) transferring the web from the creping fabric to the surface of the heated drying cylinder of the Yankee dryer such that the web is adhered to the drying cylinder by the resinous adhesive coating;

(e) drying the web to a predetermined dryness on the surface of the drying cylinder;

(f) removing the dried web from the drying cylinder surface; and (g) periodically stripping at least a portion of the resinous adhesive coating from the drying cylinder surface as the characteristic operating temperature limit of the drying hood of the Yankee dryer is approached;

wherein the furnish and resinous adhesive coating composition are selected and heating of the backing cylinder and drying cylinder is controlled and such that a production interval between successive strippings of adhesive coating from the drying cylinder has a duration of at least 4 hours, and during which production interval a predetermined target production rate of dried sheet is met, the production interval further characterized in that the average rate of increase of the characteristic operating temperature of the dryer hood over the production interval is less than 1° F./minute.

31. The method according to claim 30, wherein the average rate of increase of the characteristic operating temperature of the dryer hood over the production interval is less than 0.75° F./min.

32. The method according to claim 30, wherein the average rate of increase of the characteristic operating temperature of the dryer hood over the production interval is less than 0.5° F./min.

33. The method according to claim 30, wherein the dryer hood is provided drying energy at a rate of less than 3 MMBtu/ton for a duration of at least 30 minutes during the production interval.

34. The method according to claim 30, wherein the dryer hood is provided drying energy at a rate of less than 3 MMBtu/ton for a duration of at least 60 minutes during the production interval.

35. The method according to claim 30, wherein the resinous adhesive coating composition provided to the drying cylinder includes a polyvinyl alcohol resin and a polyamidoamine resin.

36. The method according to claim 35, wherein the resinous adhesive coating composition provided to the drying cylinder includes less than 75% by weight of polyvinyl alcohol resin.

37. The method according to claim 35, wherein the resinous adhesive coating composition provided to the drying cylinder includes less than 65% by weight of polyvinyl alcohol resin.

38. The method according to claim 35, wherein the resinous adhesive coating composition provided to the drying cylinder includes less than 60% by weight of polyvinyl alcohol resin.

39. The method according to claim 35, wherein the resinous adhesive coating composition provided to the drying cylinder includes less than 50% by weight of polyvinyl alcohol resin.

40. The method according to claim 35, wherein the resinous adhesive coating composition provided to the drying cylinder includes from about 40% by weight to about 80% by weight of polyvinyl alcohol resin.

41. The method according to claim 35, wherein the resinous adhesive coating composition provided to the drying cylinder includes from about 5% by weight polyamidoamine resin to about 35% by weight polyamidoamine resin.

42. The method according to claim 35, wherein the resinous adhesive coating composition provided to the drying cylinder includes at least 10% by weight of a polyamidoamine resin.

43. The method according to claim 35, wherein the resinous adhesive coating composition includes from about 2.5 weight % modifier to about 30 weight % modifier.

44. The method according to claim 35, wherein the resinous adhesive coating composition contains up to about 20 weight % modifier.

45. The method according to claim 35, wherein the resinous adhesive coating composition contains up to about 30 weight % modifier.

46. A method of making a fabric-creped absorbent cellulosic sheet comprising:

(a) preparing an aqueous papermaking furnish including pulp comprising pre-dried papermaking fibers which have been dried to at least 80% air-dry prior to preparing the aqueous furnish;

(b) depositing the papermaking furnish on a formaninous support;

(c) compactively dewatering the papermaking furnish to form a nascent web and concurrently applying the web to a heated rotating backing cylinder;

(d) fabric-creping the web from the heated backing cylinder surface at a consistency of from about 30% to about 60% utilizing a patterned creping fabric, the creping step occurring under pressure in a fabric-creping nip defined between the backing cylinder surface and the creping fabric wherein the fabric is traveling at a second speed slower than the speed of said backing cylinder surface, the fabric pattern, nip parameters, velocity delta and web consistency being selected such that the web is creped from the backing cylinder surface and transferred into the creping fabric;

(e) providing a hygroscopic, re-wettable resinous adhesive coating composition comprising a polyvinyl alcohol to a surface of a heated drying cylinder of a Yankee dryer at an add-on rate of about 15 $mg/m^2$ of drying cylinder surface or less such that a resinous adhesive coating is formed, the Yankee dryer also having a drying hood with a characteristic operating temperature limit;

(f) transferring the web from the creping fabric to the surface of the heated drying cylinder of the Yankee dryer such that the web is adhered to the drying cylinder by the resinous adhesive coating;

(g) drying the web to a predetermined dryness on the surface of the drying cylinder;

(h) removing the dried web from the drying cylinder surface; and (i) periodically stripping at least a portion of the resinous adhesive coating from the drying cylinder surface as the characteristic operating temperature limit of the drying hood of the Yankee dryer is approached;

wherein the furnish and resinous adhesive coating composition are selected and heating of the backing cylinder and drying cylinder is controlled such that a production interval between successive strippings of adhesive coating from the drying cylinder has a duration of at least 4 hours, and during which production interval a target production rate of dried sheet is met.

47. The method according to claim 46, wherein the pre-dried papermaking fibers are dried to at least 90% air-dry prior to preparing the aqueous papermaking furnish.

48. The method according to claim 46, wherein the pre-dried papermaking fibers are dried to at least 95% air-dry prior to preparing the aqueous papermaking furnish.

49. The method according to claim 46, wherein the pre-dried papermaking fibers include Southern Softwood Kraft fiber.

50. The method according to claim 46, wherein the pre-dried fiber has a GE brightness of at least 80.

51. The method according to claim 46, wherein the pre-dried fiber has a GE brightness of at least 85.

52. The method according to claim 46, wherein the pre-dried fiber has a GE brightness of at least 90.

53. The method according to claim 46, wherein the pre-dried papermaking fibers have a GE brightness of between about 85 and 95.

54. The method according to claim 46, wherein the pulp in the furnish comprises at least 60% by weight pre-dried fiber.

55. The method according to claim 46, wherein the pulp in the furnish comprises at least 75% by weight pre-dried fiber.

* * * * *